US007246560B2

(12) United States Patent
Shepherd

(10) Patent No.: US 7,246,560 B2
(45) Date of Patent: Jul. 24, 2007

(54) STANCHION SUPPORT

(75) Inventor: Peter Stanley Le Flemming Shepherd, Hythe (GB)

(73) Assignee: Gopak Limited, Kent (GB)

( * ) Notice: Subject to any disclaimer, the term of this patent is extended or adjusted under 35 U.S.C. 154(b) by 278 days.

(21) Appl. No.: 10/522,327

(22) PCT Filed: Jul. 15, 2003

(86) PCT No.: PCT/GB03/03064

§ 371 (c)(1),
(2), (4) Date: Jan. 25, 2005

(87) PCT Pub. No.: WO2004/010823

PCT Pub. Date: Feb. 5, 2004

(65) Prior Publication Data

US 2005/0217541 A1 Oct. 6, 2005

(30) Foreign Application Priority Data

Jul. 26, 2002 (GB) ..... 0217385.4

(51) Int. Cl.
*A47B 3/00* (2006.01)

(52) U.S. Cl. ..... 108/117; 108/124; 248/439; 248/188.6

(58) Field of Classification Search ..... 108/124, 108/126, 127, 129, 130, 131, 132, 133, 117, 108/115, 120; 248/188.6, 439, 188, 166
See application file for complete search history.

(56) References Cited

U.S. PATENT DOCUMENTS 554,981 A * 2/1896 Carter ..... 108/132
1,520,589 A 12/1924 Matkovic
2,540,875 A * 2/1951 Genge ..... 108/120
2,671,000 A * 3/1954 Rosen ..... 108/131
2,913,295 A * 11/1959 Park ..... 108/160
3,606,846 A * 9/1971 Andrews et al. ..... 108/132
6,044,775 A 4/2000 Lashlee et al. ..... 108/132
6,374,756 B1 * 4/2002 Fieldwick et al. ..... 108/131
7,093,893 B1 * 8/2006 Bunde ..... 297/17
2006/0021551 A1 * 2/2006 Pleiman ..... 108/129

FOREIGN PATENT DOCUMENTS

EP 0572331 A1 5/1993

* cited by examiner

*Primary Examiner*—Janet M. Wilkens
(74) *Attorney, Agent, or Firm*—Levy & Grandinetti

(57) ABSTRACT

A sliding pivot for a support element used with a stanchion which is hinged to the item with which it is used and from which it can be unfolded, wherein one end of the support element is rigidly attached to the stanchion and the opposite end is provided with a substantially transverse portion extending therefrom, comprises a slide, a sleeve provided with a slide pin extending in substantially the same plane as the sleeve, and a socket substantially parallel with the transverse portion, wherein the sleeve is located on the transverse portion, the pin is located in the slide, the sleeve being adapted to rotate about the transverse portion, and the pin to rotate in the slide, the pin moving along the slide when the stanchion is rotated about its hinge, the socket being adapted to receive the transverse portion when the stanchion is in a fully unfolded position.

21 Claims, 1 Drawing Sheet

STANCHION SUPPORT

Figure 1:
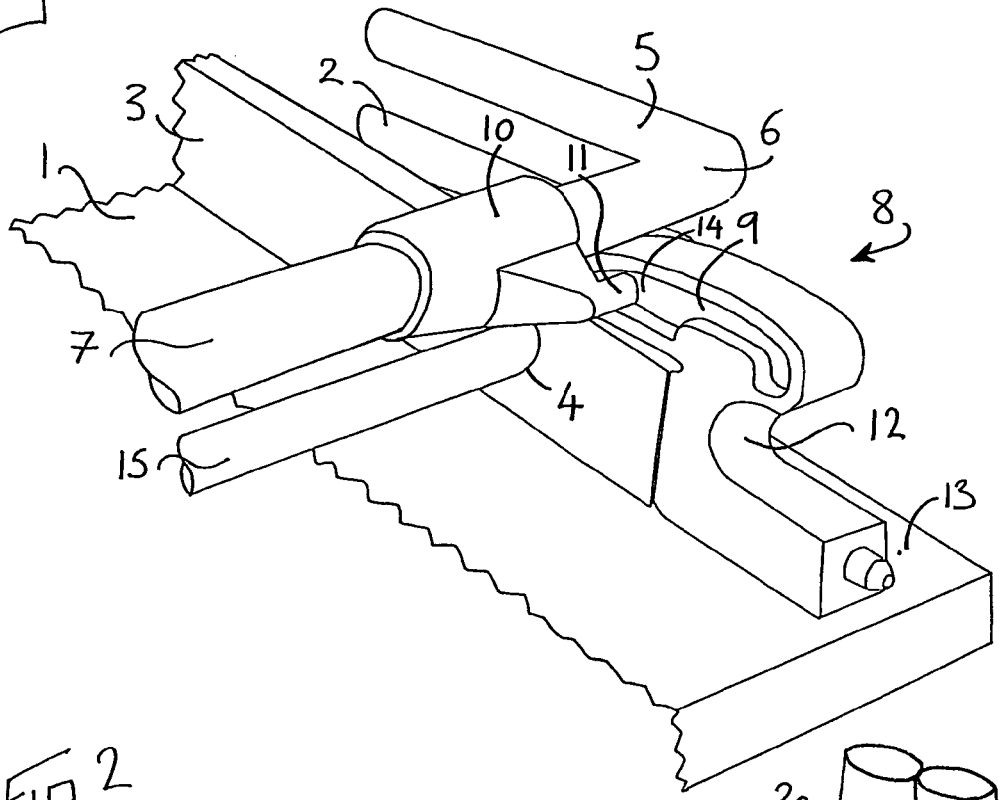

This application is the U.S. National Phase of PCT Application Number PCT/GB2003/003064, filed on 15 Jul. 2003, which claims priority to Great Britain Application Number 0217385.4, filed 26 Jul. 2002.

This invention relates to a support means for a stanchion, which is particularly, but not exclusively in the form of a table leg.

Collapsible legs for use with folding tables and chairs and the like are well known. The upper ends of the legs can be attached in a hinged arrangement to the underside of the body of the item of furniture, so that they can be folded up underneath the body for storage. There are many known types of folding mechanisms which utilise a variation of designs.

The chief aims of any folding mechanism are twofold. Firstly, the mechanism must be able to adequately support the leg when it is extended, so that the table or other article, will not collapse during use. Secondly, the mechanism must facilitate ease of use, so that the leg can be readily extended and collapsed.

One design which has proved successful comprises a pair of legs constructed from a single U-shaped component, in which the transverse interconnecting section is attached in a hinged arrangement to the underside of the table. The legs are provided with a support element which is substantially similar in size and shape to the legs component, and which is disposed alongside the legs. The two components are rigidly attached together at their outer ends in such a way that the two adjacent transverse interconnecting sections are resiliently biased together, but can be pulled apart.

When the legs are unfolded the interconnecting section of the support element is pulled away from the legs and placed in sockets provided on the underside of the table. With this arrangement the biasing together of the components holds the support element in the sockets. When the table needs to be folded up for storage, the support element can be removed from the sockets by hand, and the two components can be folded flat against the underside of the table top.

The present invention is intended to provide an improved version of the above mechanism.

According to the present invention a sliding pivot means for a support element which is used with a stanchion which is hinged to the item with which it is used and from which it can be unfolded, in which one end of the support element is rigidly attached to the stanchion and the opposite end is provided with a substantially transverse portion extending therefrom, comprises a slide, a sleeve provided with a slide pin extending in substantially the same plane as the sleeve, and a socket substantially parallel with said transverse portion, and in which the sleeve is located on the transverse portion, and the pin is located in the slide, the sleeve being adapted to rotate about the transverse portion, and the pin to rotate in the slide, the pin moving along the slide when the stanchion is rotated about its hinge, and the socket being adapted to receive the transverse portion when the stanchion is in a fully unfolded position.

Preferably the slide is curved to follow the path of the transverse portion of the support element as the stanchion is rotated about its hinge.

In one construction the socket is provided in between the underside of the item and the slide. With this arrangement the slid pin reaches the end of the slide, and the transverse portion and the sleeve rotate around the end of the slide, and into the socket.

In a preferred embodiment the item is an item of furniture. The furniture can be a table, and the stanchion can be a table leg. Further, the table leg can be part of a U-shaped two-leg component, the transverse interconnecting portion of which is hinged to the underside of the table. The support element can be substantially the same shape, and can be disposed along side the legs. The two components can be fixed together at their outer ends, in such a way that the two interconnecting portions are resiliently biased together, but can be pulled apart.

The legs and the support element can be tubular in shape, and can be constructed from any suitable material, for example wood or metal, for example steel.

The invention also includes an item provided with a sliding pivot means for a support element to be used with a stanchion which is hinged to the item, as described above.

Figure 2:
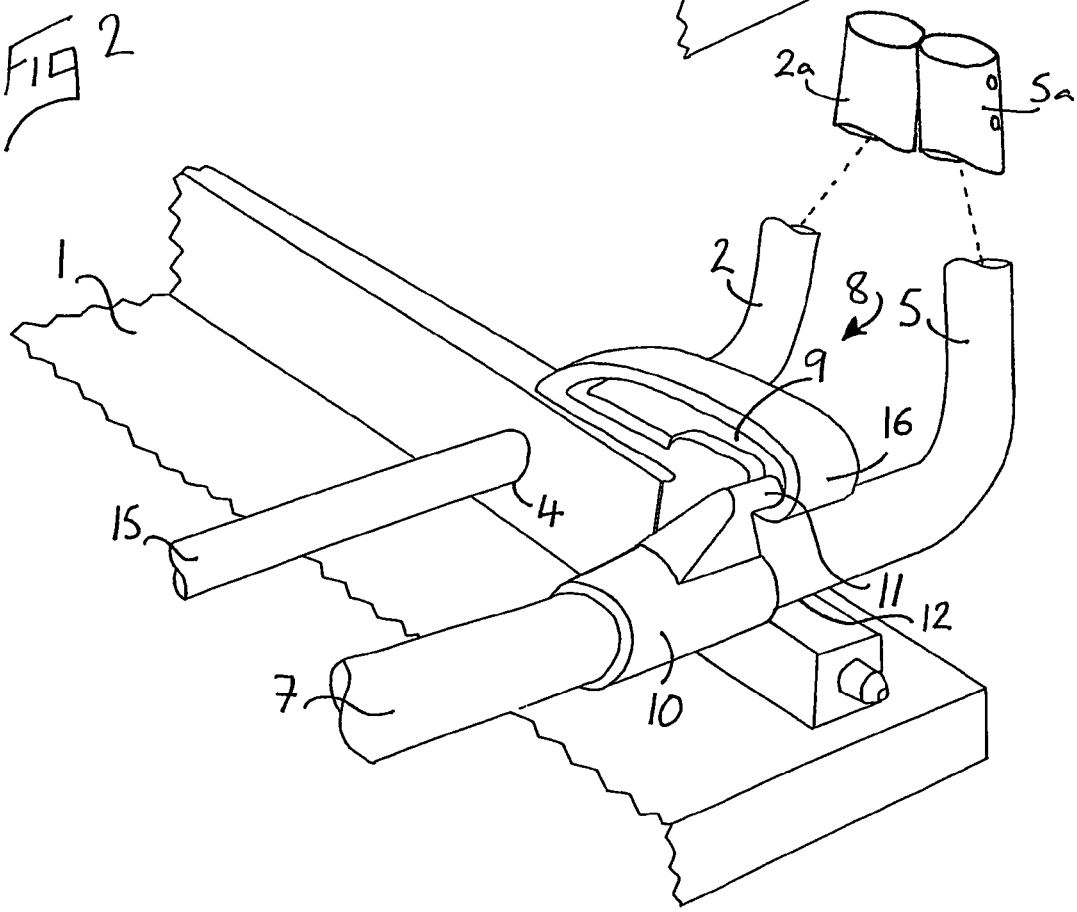

The invention can be performed in various ways, but one embodiment will now be described by way of example and with reference to the accompanying drawings, in which:

FIG. 1 is a perspective view of a sliding pivot means for a support element according to the present invention; and, FIG. 2 is a perspective view of the sliding pivot means as shown in FIG. 1, in a different configuration.

As shown in FIG. 1 a table 1 is provided with a cylindrical leg 2 which is hinged to a table support spar 3 by means of a circular aperture 4. The leg 2 is provided with a support element 5, the outer end of which 5*a* is rigidly attached to the outer end of the leg 2*a* (as shown in FIG. 2), so that there is a V shaped configuration between the leg 2 and the element 5. The inner end 6 of the element 5 is provided with a substantially transverse portion 7 extending therefrom.

The support element 5 is provided with a sliding pivot 8 comprising a slide 9, a sleeve 10 provided with a slide pin 11 extending in the same plane as the sleeve 10 and a socket 12. The sleeve 10 is disposed around the transverse portion 7, and the pin 11 is disposed in the slide 9. The sleeve 10 can rotate about the transverse portion 7, and the pin 11 can rotate on its own axis in the slide 9.

The pin 11 is adapted to move along the slide 9 when the leg 2 is rotated about its hinge 4, and the socket 12 is adapted to receive the transverse portion 7 when the leg 2 is in the fully unfolded position.

The leg 2 and the support element 5 are parts of substantially U-shaped leg pair and support element components. An opposite sliding pivot arrangement is provided at the opposite edge of the table 1.

As shown in FIG. 1 the leg 2 is in the folded position, disposed adjacent to the underside 13 of the table 1. The pin 11 is disposed at the inner end 14 of the slide 9, and the pin 11 is in a rotational position to allow the sleeve 10 and the transverse portion 7 within it to be disposed adjacent to the transverse portion 15 of the leg 2.

As shown in FIG. 2 the leg 2 is in the unfolded position. The pin 11 has been moved through the slide 9, and the pin 11 and the sleeve 10 have been rotated in a clockwise direction, to allow the transverse portion 7 to be disposed within the socket 12. The transverse portion 7 has been pulled apart from the leg 2 to allow it to be moved about the end 16 of the slide 9. The inner ends of the leg 2 and the support element 5 are resiliently biased together due to their outer ends 2*a* and 5*a* being rigidly attached together. As a result the transverse portion 7 is held in the socket 12 and the leg 2 is safely held in position.

To restore the leg 2 to the folded position the transverse portion 7 must be pulled from the socket 12 by hand, and the pin 11 must be moved and rotated back through the slide 9, in a reverse of the process described above.

Thus a table provided with a U-shaped legs component and a support element which is substantially similar in size and shape and in which the outer ends of the legs and the support elements are fixed together, is provided with a novel folding and supporting system which adequately supports the leg, and can be readily used.

The system is also provided with a small number of simple moving parts which are easy to construct. Further, the transverse portions of the legs and the support elements cannot be pulled too far apart due to the support element being held in a slide. This increases the lifespan of the leg.

The invention claimed is:

1. A sliding pivot means comprising:

a support element used with a stanchion which is hinged to an item with which it is used and from which it can be unfolded, in which one end of the support element is rigidly attached to the stanchion and the opposite end is provided with a substantially transverse portion extending therefrom, a slide, a sleeve provided with a slide pin extending in substantially the same plane as the sleeve, and a socket substantially parallel with said transverse portion, and in which the sleeve is located on the transverse portion, and the pin is located in the slide, the sleeve being adapted to rotate about the transverse portion, and the pin to rotate in the slide, the pin moving along the slide when the stanchion is rotated about its hinge, and the socket being adapted to receive the transverse portion when the stanchion is in a fully unfolded position.

2. A sliding pivot means as claimed in claim 1 in which the slide is arcuate in shape, and in which the arcuate shape is substantially parallel with the arc defined by the movement of the transverse portion when the stanchion is rotated about its hinge.

3. A sliding pivot means as claimed in claim 2 in which the socket is provided between the item and the slide, and in which the stanchion and the support are sufficiently resilient to allow their unattached ends to be sufficiently separated to allow the transverse portion to travel around the end of the slide and access the socket when the pin is disposed at the end of the slide.

4. A sliding pivot means as claimed in claim 3 in which the stanchion and the support are sufficiently resilient to hold the transverse portion in position when it is disposed in the socket.

5. A sliding pivot means as claimed in claim 4 in which the item is a table, and the stanchion is a table leg.

6. A sliding pivot means as claimed in claim 1 in which the item is a table, and the stanchion is a table leg.

7. An item to which a stanchion is hinged and can be unfolded, comprising a support element and sliding pivot means, in which one end of the support element is rigidly attached to the stanchion and the opposite end is provided with a substantially transverse portion extending therefrom, and in which the sliding pivot means comprises a slide, a sleeve provided with a slide pin extending in substantially the same plane as the sleeve, and a socket substantially parallel with said transverse portion, and in which the sleeve is located on the transverse portion, and the pin is located in the slide, the sleeve being adapted to rotate about the transverse portion, and the pin to rotate in the slide, the pin moving along the slide when the stanchion is rotated about its hinge, and the socket being adapted to receive the transverse portion when the stanchion is in a fully unfolded position.

8. A table to which a leg is hinged and can be unfolded comprising a support element and sliding pivot means, in which one end of the support element is rigidly attached to a stanchion and the opposite end is provided with a substantially transverse portion extending therefrom, and in which the sliding pivot means comprises a slide, a sleeve provided with a slide pin extending in substantially the same plane as the sleeve, and a socket substantially parallel with said transverse portion, and in which the sleeve is located on the transverse portion, and the pin is located in the slide, the sleeve being adapted to rotate about the transverse portion, and the pin to rotate in the slide, the pin moving along the slide when the stanchion is rotated about its hinge, and the socket being adapted to receive the transverse portion when the stanchion is in a fully unfolded position.

9. A table as claimed in claim 8 in which four legs are hinged and can be unfolded, and in which a support element and sliding pivot means are provided for each leg.

10. A table as claimed in claim 9 in which the four legs are comprised of two substantially U-shaped leg members, the interconnecting portions of which are hinged to the underside of the table.

11. A table as claimed in claim 10 in which the four support elements are comprised of two substantially U-shaped support members, the interconnecting portions of which comprise the transverse portions, and in which the support members are substantially the same shape and size as the U-shaped leg members, and in which the leg members and support members are rigidly connected at their two outer ends.

12. A furniture leg apparatus comprising a leg, a support element disposed substantially parallel to the leg, and a socket, in which the leg is attached to an item of furniture in a hinged arrangement, in use, in which an outer end of the support element is attached to the leg such that an inner end of the support element is biased towards the leg, in which the inner end of the support element has a substantially transverse portion extending therefrom, in which the socket faces away from the leg, and in which the transverse portion is spaced from the leg and contained in the socket when the leg is unfolded, in use, characterized in that the transverse portion is provided with guide means comprising a sleeve rotatably mounted on the transverse portion and a slide pin extending from the sleeve, and in which the furniture leg apparatus further comprises a slide in which the slide pin is located, and along which it moves when the leg is rotated, in use.

13. The furniture leg apparatus of claim 12 wherein the slide is arcuate in shape, and wherein the arcuate shape is substantially parallel with an arc defined by the movement of the transverse portion when the leg is rotated about its hinge.

14. The furniture leg apparatus of claim 13 wherein the socket is provided between the item of furniture and the slide, and wherein the leg and the support element are sufficiently resilient to allow their unattached ends to be sufficiently separated to allow the transverse portion to travel around the end of the slide and access the socket when the pin is disposed at the end of the slide.

15. The furniture leg apparatus of claim 14 wherein the leg and the support element are sufficiently resilient to hold the transverse portion in position in the socket, in use.

16. The furniture leg apparatus of claim 12 wherein the leg is a table leg.

17. The furniture leg apparatus of claim 16 wherein the leg is part of a U-shaped two-leg component, the transverse interconnecting portion of which is hinged to the underside of the table.

18. The furniture leg apparatus of claim 17 wherein the support element is part of a U-shaped two-support element component which is substantially the same shape as the U-shaped two-leg component and is disposed substantially parallel to the U-shaped two-leg component, and wherein the U-shaped two-leg component and the U-shaped two-support element component are fixed together at their outer ends, such that the transverse interconnecting portions of the U-shaped two-leg component and the U-shaped two-support element component are biased together, but can be pulled apart by hand, in use.

19. An item of furniture provided with at least one furniture leg apparatus comprising a leg, a support element disposed substantially parallel to the leg, and a socket, in which the leg is attached to said item of furniture in a hinged arrangement, in which an outer end of the support element is attached to the leg such that an inner end of the support element is biased towards the leg, in which the inner end of the support element has a substantially transverse portion extending therefrom, in which the socket faces away from the leg, and in which the transverse portion is spaced from the leg and contained in the socket when the leg is unfolded, in use, characterized in that the transverse portion is provided with guide means comprising a sleeve rotatably mounted on the transverse portion, a slide pin extending from the sleeve, and a slide in which the slide pin is located, and along which it moves when the leg is rotated, in use.

20. The item of furniture of claim 19 wherein the item of furniture is a table.

21. The item of furniture of claim 20 wherein the table is provided with four legs, in which the four legs comprise two U-shaped two-leg components, the transverse interconnecting portions of which are hinged to the underside of the table, and in which the four support elements comprise two U-shaped two-support element components substantially the same shape as the U-shaped two-leg components and disposed substantially parallel to the U-shaped two-leg components, and in which the U-shaped two-leg component and the U-shaped two-support element components are fixed together at their outer ends, such that the transverse interconnecting portions of the U-shaped two-leg components and the U-shaped support element components are biased together, but can be pulled apart by hand, in use.

* * * * *